US005121406A

United States Patent [19]

Hugo et al.

[11] Patent Number: 5,121,406

[45] Date of Patent: Jun. 9, 1992

[54] INDUCTION MELTING FURNACE

[75] Inventors: Franz Hugo, Aschaffenburg; Erwin Wanetzky, Grosskotzenburg, both of Fed. Rep. of Germany

[73] Assignee: Leybold Aktiengesellschaft, Hanau, Fed. Rep. of Germany

[21] Appl. No.: 559,168

[22] Filed: Jul. 30, 1990

[30] Foreign Application Priority Data

Jun. 13, 1990 [DE] Fed. Rep. of Germany ..... 4018925

[51] Int. Cl.[5] ..... F27D 3/00

[52] U.S. Cl. ..... 373/142; 373/76; 373/77; 373/78; 373/138; 373/140; 373/141

[58] Field of Search ..... 373/142, 140, 152, 156, 373/159, 160, 161, 163, 71-78, 141, 138; 219/10.491

[56] References Cited

U.S. PATENT DOCUMENTS

| | | | |
|---|---|---|---|
| 2,021,221 | 11/1935 | Benner et al. | 373/142 |
| 2,686,864 | 8/1954 | Wroughton et al. | 373/138 |
| 2,686,865 | 8/1954 | Kelly | 373/141 |
| 3,180,633 | 4/1965 | Taylor | 373/141 |
| 3,413,401 | 11/1968 | Dillon et al. | 373/141 |
| 3,461,215 | 8/1969 | Reboux | 373/158 |
| 3,484,840 | 12/1969 | Spoth et al. | 373/142 |
| 4,403,955 | 9/1983 | Sarno | 432/158 |
| 4,723,996 | 2/1988 | Burnet et al. | 373/138 |

FOREIGN PATENT DOCUMENTS

| | | |
|---|---|---|
| 0345541 | 12/1989 | European Pat. Off. . |
| 3927998 | 1/1990 | Fed. Rep. of Germany . |

*Primary Examiner*—Marvin M. Lateef
*Assistant Examiner*—Tu Hoang
*Attorney, Agent, or Firm*—Felfe & Lynch

[57] ABSTRACT

The invention relates to an induction melting furnace 1 for metals which are difficult to melt including an induction coil 2 surrounding the crucible 3 and a mold receptacle 4 surrounded by an annular chamber 5 to hold the cooling agent. The crucible 3 is disposed in a housing 7 provided with a vacuum connection 6. In order to improve the microporous nature, the melt contained in the mold receptacle 4 is compressed by means of a pressure which is build up in the mold receptacle 4 prior to the cooling.

12 Claims, 2 Drawing Sheets

INDUCTION MELTING FURNACE

Figure 1:
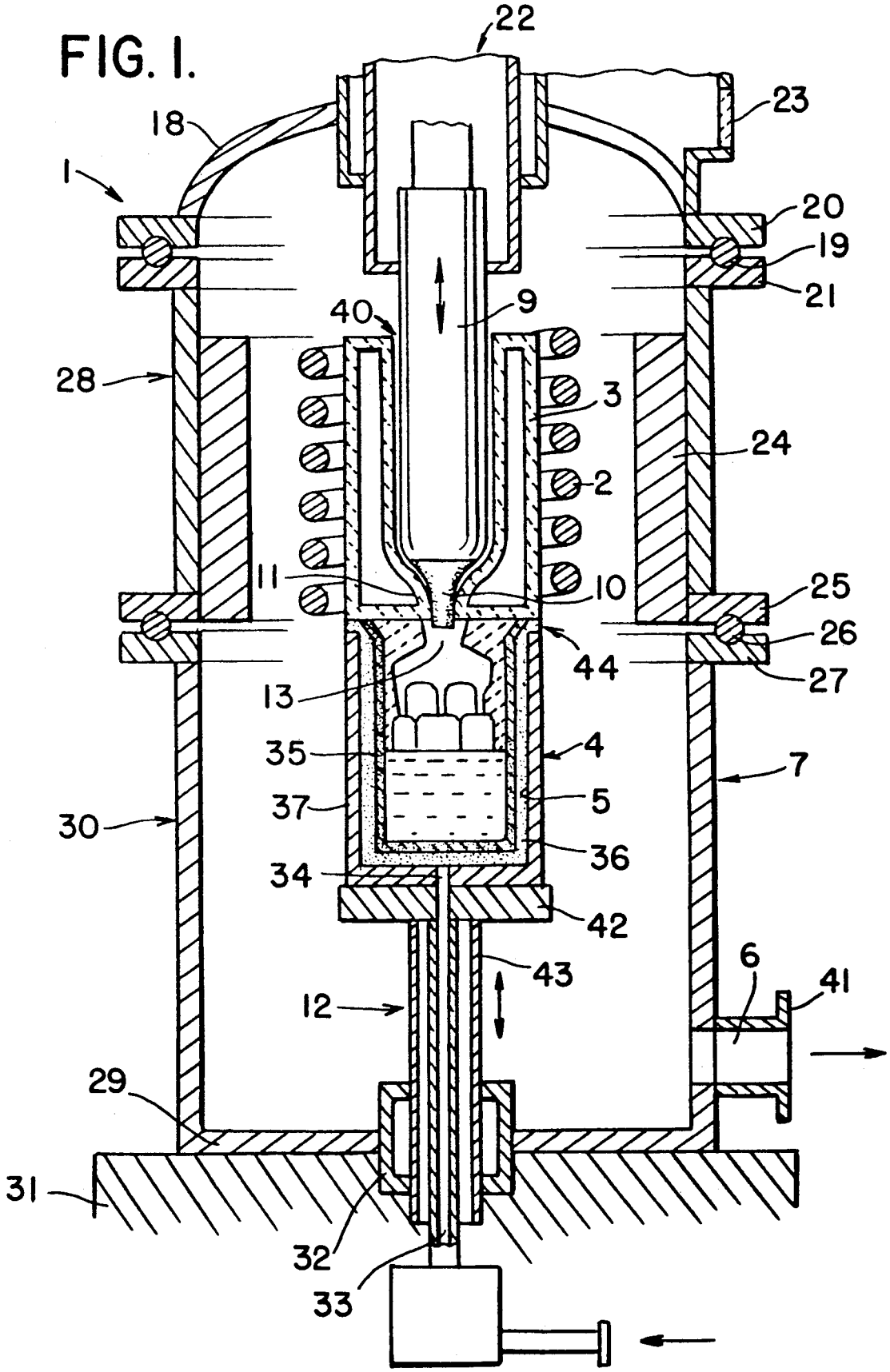

The invention relates to an induction melting furnace for metals which are difficult to melt including an induction coil enclosing the crucible and a mold receptacle surrounded by an annular chamber for the reception of a cooling agent. The induction melting furnace is surrounded by a housing provided with a vacuum connection.

A method of melting small amounts of metal is already known (EP 345 541 A2) which makes use of a cold melting crucible for this purpose. The cold melting crucible includes a top crucible where correspondingly shaped wall segments form the crucible trough and a base part. Cooling channels which include the supply lines for the cooling agent run alongside the walls. Further, the base part has another flange to receive a pressure container, and the individual wall elements are surrounded by a high frequency coil. This apparatus is not suited for small charges since surface tension and viscosity of the melt do not allow a sufficient compression of the melt in the crucible.

Moreover, a casting method of the aforesaid kind is known (DE 39 998) where the material is cast in an inert gaseous atmosphere. This method involves tilt casting where the melt is flows into the mold receptacle when the gaseous atmosphere is present. The melt which is poured into the mold receptacle must displace the gas contained in the mold before it can enter the most minute parts of the mold receptacle. Gas voids and bubble formation in the metal can thus not be excluded.

The object underlying the present invention is to further elaborate the induction melting furnace with its mold receptacle such that the microporous nature of the metal, particularly titanium, obtained after the casting cycle is improved even with very small charges and correspondingly high surface tensions of the melt. This object is accomplished in accordance with the invention in that with the vacuum being present, the melt contained in the mold receptacle can be compressed by building up pressure above the melt prior to the cooling. This ensures that despite a high viscosity of the melt and a correspondingly occurring surface tension, even small charges that are filled in a mold receptacle are well compressed since the pressure above the melt ensures that the melt evenly fills the mold receptacle while voids are avoided. Growing dendrites thus prevent the formation of cavities since a corresponding pressure causes the melt to flow even through the most minute cavities caused by the growth of dendrites. For this purpose, it is advantageous to provide a pressure piston above the inlet opening of the mold receptacle which can be inserted into the latter. With the use of the pressure piston, it is possible to provide a good compression during the solidification in a most simple way. Even smallest charges can thus be cast. The so far problematic surface tension of the melt occurring with these small charges can now be neglected since the pressure piston permits a post compression of the melt poured in the mold receptacle.

According to a particular feature, the accomplishment in accordance with the invention determines that the pressure piston contained in the housing, can be vertically moved in the latter. Further, at its front end to be immersed in the melt, the pressure piston is provided with a ceramic coating in order to increase its resistance. It can also be used for metals having a high melting point. Moreover, a so configured pressure piston can be used to press the melt out through the outlet opening of the crucible and to ensure a sufficient compression of the melt in the mold receptacle.

By use of a lifting device, the invention permits approaching the mold receptacle with its inlet opening to the outlet opening of the crucible in a most simple way.

In another advantageous configuration of the invention, a closing cap used to build up a gas pressure can be attached above the crucible. This is an alternative possibility of pressing the melt into the mold receptacle and to build up pressure over the melt contained in the mold receptacle in order to thus ensure a sufficient post compression of the melt prior to its solidification.

In the apparatus in accordance with the invention, it is of particular importance, that the mold receptacle includes an internal and an external container between which the annular chamber is formed. The latter is surrounded by porous ceramic material through which argon is passed to achieve a faster cooling of the casting. It is particularly advantageous when the casting is cooled down fast so as to obtain a fine-grain structure. The argon supplied to the ceramic material is evaporated and thus withdraws thermal energy from the melt. The argon, which is then allowed to escape to the exterior, causes the pressure to increase in the interior of the housing and thus a post compression of the melt in the mold receptacle. Further, it is also possible to spray liquid argon on the mold receptacle. The also rapidly occurring evaporation of the argon causes a fast pressure increase up to argon supply pressure (advantageously approximately 10 bar), for example in a titanium melt. The solidification at excess pressure further improves the microporous nature of the casting.

In a further embodiment of the invention, a suspended coil is advantageously provided above the mold receptacle between which the melt is formed and/or held. This ensures that the melt drops into the mold receptacle below the coil once the melting current is switched off. Here, it is particularly advantageous when the pressure piston, for the post compression, is pressed into the mold receptacle immediately after switching off the melting current. The ceramic coating frozen in the mold head is advantageously separated from the casting together with the dead mold.

In yet another embodiment of the invention, it is particularly advantageous that the outlet funnel provided at the bottom end of the crucible is coaxially aligned with the mold receptacle and that the melting crucible is tapered toward the bottom. Moreover, it is advantageous when the crucible is surrounded by an annular chamber and that the pressure piston is pressed into the mold receptacle. It is particularly advantageous here that metal can be withdrawn from the bottom whereby the pressure in the prevailing vacuum acts only on the surface of the melt. A mixing between melt and gas during the casting cycle is thus avoided. The melt flow enters the mold receptacle while the vacuum is present. This ensures a high purity of the melt and excludes at the same time gas voids in the form of bubbles.

Additional features of the invention are represented in the description of the Figs. Note that each individual feature and each combination of individual features is essential to the invention. The Figs. show an embodiment of the invention as an example without limiting the invention thereto. Referring now to the Figs.

Figure 2:
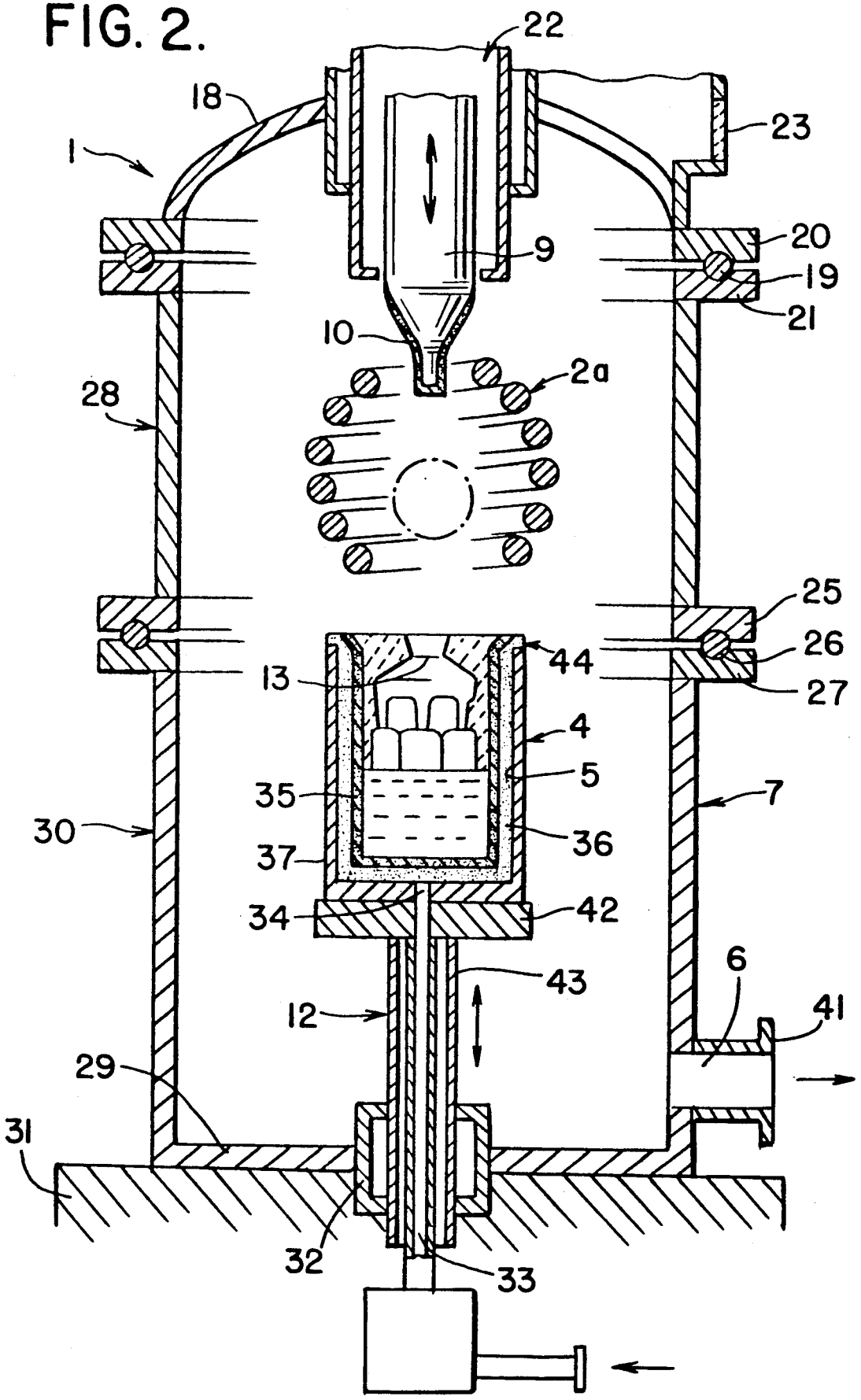

FIG. 1 is an induction melting furnace with a cold crucible and a mold receptacle disposed underneath to hold the molten material, FIG. 2 is another embodiment of the induction melting furnace inclusive of the appertaining mold receptacle.

In the drawing, the induction melting furnace bears the reference numeral 1. It includes a housing 7 which, on its top, is provided with a cover 18 having a flange 20. A sealing 19 serves to press this flange 20 against another flange 21 provided at part 28 of the housing.

The cover 18 can be provided with an inspection window 23 to monitor the casting and/or the solidification of the melt. This cover 18 also has an inlet opening 22 through which the melt is introduced.

The housing 7 includes an upper and a lower part 28 and 30. These two parts are connected by means of two flanges 25 and 27 with a sealing 26 being provided between these two flanges 25 and 27.

In the drawing, the housing 7 of the induction melting furnace 1 rests on a pedestal 31 which is only diagrammatically indicated. The housing 7 has a bottom 29 with a piece 32 to which a connecting line 33 for the supply of argon is connected. The connecting line 33 is in flow-connection with a non-represented reservoir for the supply of argon. The connecting line 33 enters the interior of the housing 7 where it is connected to an inlet opening 34 of the mold receptacle 4.

The mold receptacle 4 has an inner wall 35 in its interior. An annular chamber 5 to hold a porous ceramic material is formed between the inner wall 35 and the external wall 37 of the mold receptacle 4. Argon can be passed through the porous ceramic material 36 in order to accelerate the cooling during the solidification of the melt. After the evaporation, the argon is conducted toward the outside into the interior of the housing 7 to allow pressure to build up in the interior and, hence, above the melt. This ensures a sufficient post compression of the melt while it solidifies.

Above the mold receptacle 4 there is a crucible 3 for metals which are difficult to melt, for example titanium. In its interior, the crucible or cold crucible 3 may consist of segments. The crucible 3 is tapered toward the bottom where it has an outlet opening 11 for the melt to be supplied to the interior of the mold receptacle via withdrawal from the bottom.

The top end of the crucible 3 is configured as an inlet opening 40. It is also possible to close the inlet opening 40 of the crucible 3 with a pressure cap which is not represented in the drawing in order to supply argon via a corresponding inlet opening into the interior of the crucible and thus build up the desired pressure above the melt.

As further seen in FIG. 1, a pressure piston 9 is in the interior of the crucible 3 during the withdrawal of melt. This piston can be introduced through an inlet opening 40 of the crucible 3. It is made of a high-temperature resistant metal. It is tapered toward the front and has a ceramic coating 10 on its downward end. After pouring the melting material in the mold receptacle 4, the melt is post compressed in that the piston 9 applies pressure to the melt. The pressure piston 9 is therefore guided through the outlet opening 11 and then into the inlet opening 13 of the mold receptacle 4. As already mentioned, argon is supplied to the annular chamber 5 to expedite the cooling in the mold. When using a titanium melt of ca. 10 bar, the rapid evaporation of the argon causes the pressure to increase fast. The pressurized solidification improves the microporous nature.

In the area of the bottom 29 of the lower part 30 of the housing, there is a non-represented flange 41 with a connecting piece 6 connected to a vacuum pump for the purpose of evacuating the housing 7.

The melt contained in the crucible 3 is melted by an induction coil 2 surrounding the crucible 3. The induction coil 2 has a yoke 24 surrounding said coil 2. The yoke is sufficiently spaced-apart from the external wall of the crucible 3 to ensure that thermal energy is supplied only to the melt and not to the wall.

The mold receptacle 4 provided underneath the crucible 3 is disposed on a table 42 which is mounted to a lifting column 43. The lifting column 43 is guided by means of the guiding piece 32 and has a hollow configuration. In its interior it holds the connecting line 33 for the supply of the argon to the annular chamber 5 of the mold receptacle 4. The lifting device or lifting column 43 permits placing the mold crucible 4 exactly below the crucible 3.

The melt is produced and withdrawn as follows:

First, the melting material is supplied to the housing 7, the crucible 3, that is. The housing 7 is then closed by means of the cover 18. The induction melting furnace 1 is then evacuated by means of a non-represented vacuum pump which is connected via a flange 41. Now, the melting material can be molten in the prevailing vacuum by means of the induction coil 2. After the melting material is completely molten, it is withdrawn via the outlet opening 11 and supplied to the mold receptacle 4. The pressure piston presses all of the molten material into the mold receptacle. This ensures that the mold receptacle is completely and uniformly charged.

In order to expedite the cooling process, argon is now supplied to the annular chamber 5 via the connecting line 33. The fast evaporation of the argon withdraws thermal energy from the melt. At the same time, the pressure in the housing 7 is increased since the opening 44 connects the annular chamber 5 to the interior of the housing 7. The rapid pressure increase to ca. 10 bar during the solidification ensures a good filling of the structure since the usually occurring dendrites cannot form. The gas pressure and the pressure piston 9 further ensure that even the most minute ramifications of the mold are filled with melt.

Once solidified, the pressure is reduced, the housing is opened and the mold is withdrawn. Then a new mold is inserted and the casting cycle can be repeated. The arrangement in accordance with the invention and the melting process in accordance with the invention are particularly suitable for small charges, particularly titanium in the gram range, hence, also for castings used in tooth replacements.

The embodiment of FIG. 2 differs only slightly from the embodiment of FIG. 1. Instead of the annular coil 2 of FIG. 1, this induction melting furnace has a suspended coil 2*a*. In this casting process, the melt drops into the mold receptacle provided underneath the melting crucible 3 once the suspended coil 2*a* was switched off. The pressure piston 9 can be preheated for post-compression and be pressed in the mold immediately after the melting current has been shut down. The ceramic coating, frozen in the pressure piston 9, is then separated from the casting together with the dead mold.

We claim:

1. Induction melting furnace for metals comprising:

a crucible having an outlet opening;

an annular chamber for holding a cooling agent;

a mold receptacle communicating with the crucible at said outlet opening and surrounding the annular chamber;

a housing enclosing the crucible, the annular chamber and the mold receptacle, the housing having a vacuum connection;

the annular chamber communicating with the housing for communicating the cooling agent as a gas to the housing after evaporation to build up pressure in the housing;

when a vacuum is present, a melt contained in the mold receptacle being compressible prior to cooling by a pressure build-up above the mold receptacle.

2. Induction melting furnace in accordance with claim 1 in which the mold receptacle has an inlet opening and said furnace includes a pressure portion mounted to the housing for introduction into the mold receptacle, the pressure piston pressing the melt from the crucible, into the mold receptacle.

3. Induction melting furnace in accordance with claim 1, which includes a pressure piston mounted to the housing so that the piston is vertically movable.

4. Induction melting furnace in accordance with claim 1, in which the pressure piston has an end immersible in the melt and has a ceramic coating at said end thereof which is immersible in the melt.

5. Induction melting furnace in accordance with claim 2 in which the pressure piston has a bottom end which extends across the outlet opening of the crucible and in which the pressure piston has a front end adjacent the bottom end with the front end of the pressure piston being tapered toward the bottom end.

6. Induction melting furnace in accordance with claim 2 which includes a lifting device for approaching the inlet opening of the mold receptacle to the outlet opening of the crucible.

7. Induction melting furnace in accordance with claim 1, in which the mold receptacle includes an inner wall and an outer wall forming the annular chamber therebetween.

8. Induction melting furnace in accordance with claim 1 in which the crucible has a withdrawal funnel at a lower end thereof and the crucible is coaxially aligned with the mold receptacle.

9. Induction melting furnace in accordance with claim 1 in which the crucible has a bottom end and the crucible is tapered toward the bottom.

10. Induction melting furnace in accordance with claim 1 which includes an annular chamber surrounding the crucible.

11. Induction melting furnace in accordance with claim 1 which includes a preheated pressure piston.

12. Induction melting furnace for metals comprising:

an annular chamber for holding a cooling agent;

a mold receptacle surrounding the annular chamber;

above the mold receptacle a suspended coil within which a mold is formed and suspended;

a housing having a vacuum connection;

the annular chamber communicating with the housing for communicating the cooling agent to the housing after evaporation to build up pressure in the housing;

when a vacuum is present, melt contained in the mold receptacle being compressible prior to cooling by a pressure build-up above the mold receptacle.

* * * * *